United States Patent [19]

Przyluski et al.

[11] 4,333,802

[45] Jun. 8, 1982

[54] METHOD OF ELECTROCHEMICAL OBTAINING OF BRIGHT TIN COATINGS

[75] Inventors: Jan Przyluski; Kazimierz Madry; Zbigniew Dolecki; Andrzej Kotarski; Maria Drygas; Jacek Kokosinski; Zygmunt Kuzma; Bohdan Chelminski, all of Warsaw, Poland

[73] Assignee: Politechnika Warszawska, Warsaw, Poland

[21] Appl. No.: 227,306

[22] Filed: Jan. 22, 1981

Related U.S. Application Data

[63] Continuation-in-part of Ser. No. 109,581, Jan. 4, 1980, abandoned.

[30] Foreign Application Priority Data

Jan. 11, 1979 [PL] Poland ..... 212740

[51] Int. Cl.[3] ..... C25D 3/32

[52] U.S. Cl. ..... 204/54 R

[58] Field of Search ..... 204/54 R

[56] References Cited

U.S. PATENT DOCUMENTS

| | | | |
|---|---|---|---|
| 3,361,652 | 1/1968 | Korpiun et al. | 204/54 R |
| 3,585,114 | 6/1971 | Wren et al. | 204/54 R |
| 3,755,096 | 8/1973 | Passal | 204/54 R |
| 4,139,425 | 2/1979 | Eckles et al. | 204/54 R |

*Primary Examiner*—Howard S. Williams

*Attorney, Agent, or Firm*—Ladas & Parry

[57] ABSTRACT

In a method for the electrodeposition of bright tin coatings by the use of an electroplating bath comprising a solution of stannous sulfate and sulfuric acid, the improvement which comprises adding to the bath an alcoholic solution containing from 14 to 30 percent by weight of a surface active agent, from 0.5 to 5 percent by weight of an unsaturated carbonyl compound containing an aryl group, from 1.0 to 10.0 percent by weight of the product of transesterification of a natural fat, and at least one of the following ingredients: from 0 to 8 percent by weight of an ester of an unsaturated acid and from 0 to 15 percent by weight of compound containing an ether group, the said solution being added to the bath in the ratio of 1 part of solution to 20 to 35 parts by weight of the bath.

1 Claim, No Drawings

METHOD OF ELECTROCHEMICAL OBTAINING OF BRIGHT TIN COATINGS

This is a continuation-in-part of Patent Application Ser. No. 109581 filed Jan. 4, 1980, now abandoned.

This invention relates to a method for the electrodeposition of bright tin coatings by means of electroplating from acid stannous sulfate solutions.

Bright tin coatings characterized by good adhesion to the base, very good soldering ability and high corrosion resistance are ussed in electronics, e.g. in leads of diodes, transistors, and integrated circuits.

By means of sulfate electroplating baths tin coatings are obtained on surfaces of metallic objects or other objects conducting electric current, the utilization of said coatings being limited in industrial practice because they appear most often in a coarse-crystalline form and are loosely attached to the base. In order to improve the utilization properties of such coatings various additives are applied to galvanic solutions. The standard additives known from U.S. Pat. Nos. 3,755,096 and 3,634,212 are substances having the nature of surface-active agents, which due to better wetting of the cathode cause increased adhesion of coatings to the base. The electroplating process is also improved by the addition of substances which prevent oxidation of $Sn^{+2}$ ions to $Sn^{+4}$ ions, such as for example, hydroquinone or β-naphthol, known from U.S. Pat. No. 3,082,157 and German Federal Republic Pat No. 1,952,218. Organic solvents are also applied, most often alcohols, which enable homogenization in a solution of chemical compounds sparingly soluble in water. Other additives which have advantageous effects are substances having the nature of colloids, such as gelatine, and carpenter's glue, described in Ref. Zurn. Chim. 11L 35o, 1970.

However, tin coatings obtained by means of the above additives, although being better attached to the base, have matt surfaces of various degrees of smoothness, this being associated with an insufficient soldering ability and low corrosion resistance.

In order to obtain bright tin coatings other additional components for electroplating baths have been proposed. They are substances of natural origin, such as cellulose derivatives, and wood tar extracts, as described in German Federal Rpublic Pat. No. 971,778 and British Pat. No. 443,429. A number of tests also have been made with other brightening additives, such as polyethoxyl compounds, aromatic amines, amides, sulfone derivatives, and phenylase dyes; see U.S. Pat. Nos. 1,089,479, and 3,585,114; French Pat. No. 2,095,375, and German Federal Republic Pat. No. 1,956,144. However, such additives do not provide the required effect, and coatings obtained by means of these additives show turbidity and colored stains. These defects are directly associated with a worse soldering ability and higher corrosion susceptibility.

It has been observed that the effect of the action of particular brightening agents while using each of them separately is insufficient. On the other hand, a synergistic effect of several substances used at appropriate proportions prvides the desired improved result.

In accordance with the present invention there is provided in a method for the electrodeposition of bright tin coatings by the use of an electroplating bath comprising a solution of stannous sulfate and sulfuric acid, the improvement which comprises adding to the bath an alcoholic solution containing from 14 to 30 percent of a surface-active agent, from 0.5 to 5 percent of an unsaturated carbonyl compound containing an aryl group, from 1.0 to 10.0 percent by weight of the product of transesterification of a natural fat, and at least one of the following ingredients: from 0 to 8 percent by weight of an ester of an unsaturated acid and from 0 to 15 percent by weight of a compound containing an ether group, the said solution being added to the bath in the ratio of 1 part of solution to 20 to 35 parts by weight of the bath.

Additions of esters of unsaturated acids, and compounds containing ether groups are introduced to the electroplating bath in order to complement the synergism of action provided by the improvement of the present invention.

The method of obtaining of bright tin coatings according to the invention is carried out at current density of $50 \div 600$ A/m$^2$ and at current efficiency above 95%.

Tin coatings obtained by the method of the invention are characterized by bright polish and even after prolonged exposure to a strong corrosion environment, they preserve an excellent soldering ability.

The invention is illustrated by the following Examples.

EXAMPLE I 10 g. of technical tallow is heated and mixed for a period of 2 hours with 50 g. of methanol in the presence of sulfuric acid. The product is distilled and the fraction boiling at a temperature of 70° to 120° C. is collected. A mixture is prepared which contains 1 g. of the distillation fraction, 2 g. of methyl acrylate, and 0.5 g of benzylidene acetone. The said mixture is dissolved in 50 g. of methanol with an addition of 25 g. of the surface-active agent alphenol and 10 g of pyrocatechol. The solution prepared in this manner is added to an electroplating bath containing stannous sulfate and sulfuric acid at a quantity of 1 part by weight of the solution per 30 parts by weight of the bath. Then, a copper plate is tinned electrochemically at a temperature of 20° C. at current density of 300 A/m$^2$. A homogeneous, bright tin coating is obtained.

EXAMPLE II 10 g. Of rape-seed oil is heated and mixed for a period of 1 hour with 50 g. of ethanol in the presence of sulfuric acid. The product is distilled and a fraction boiling at a temperature of 75° to 110° C. is collected: A mixture is prepared which contains 5 g. of the distillation fraction, 12 g. of ethyl acetal of formaldehyde and 4 g. of dibenzylidene acetone. The mixture is dissolved in 100 g. of ethanol with an addition of 40 g. of the surface-active agent rokaphenol N-8 and 25 g of hydroquinone. The solution thus prepared is added to an electroplating bath containing stannous sulfate and sulfuric acid at a quantity of 1 part by weight of the solution per 20 parts by weight of the bath. Then a plate made of ferronickel-cobalt alloy is tinned electrochemically at a temperature of 15° C. at current density of 100 A/m$^2$. A homogeneous, bright tin coating is obtained.

EXAMPLE III 10 g. of pig's lard is heated and mixed for a period of 3 hours with 100 g. of methanol in the presence of phosphoric acid. The product is distilled and a fraction boiling at 50° to 100° C. is collected. A mixture is prepared which contains 3 g. of the distillation fraction, 8 g. of methyl acetal of propionic aldehyde, 5 g. of butyl acrylate and 1 g. of cinnamic aldehyde. The said mixture is dissolved in 50 g. of methanol with an addition of 15 g. of the surface-active agent renex 690 and 20 g. of hydroquinone. The solution thus prepared is added to an electroplating bath containing stannous sulfate and sulfuric acid at a quantity of 1 part by weight of the solution per 25 parts by weight of the bath. Then a plate made of armco alloy is tinned at a temperature of 30° C. at current density of 500 A/m$^2$. A homogeneous, bright tin coating is obtained.

EXAMPLE IV 10 g. Of technical tallow is heated and mixed for a period of 1 hour with 80 g. of ethanol in the presence of sulfuric acid. The product is distilled and a fraction boiling at a temperature of 80° to 110° C. is collected. A mixture is prepared which contains 2 g. of the distillation fraction, 3 g. of isopropyl ether and 1 g. of benzylidene acetone. The mixture is dissolved in 100 g. of ethanol with an addition of 35 g. of the surface-active agent alphenol and 15 g. of $\beta$-naphthol. The solution thus prepared is added to an electroplating bath containing stannous sulfate and sulfuric acid at a quantity of 1 part by weight of the solution per 35 parts by weight of the bath. Then an iron plate is tinned electrochemically at a temperature of 18° C. at current density of 50 A/m$^2$. A homogeneous, bright tin coating is obtained.

EXAMPLE V 10 g. Of soybean oil is heated and mixed for a period of 2 hours with 100 g. of methanol in the presence of sulfuric acid. The product is distilled and a fraction boiling at a temperature of 90° to 120° C. is collected. A mixture is prepared which contains 10 g. of the distillation fraction, 8 g. of methyl acrylate, 5 g. of ethyl ether and 1 g. of chalcone. The mixture is dissolved in 40 g. of methanol with an addition of 30 g. of the surface-active agent rokaphenol N-8 and 15 g. of pyrocatechol. The solution thus prepared is added to an electroplating bath containing stannous sulfate and sulfuric acid at a quantity of 1 part by weight of the solution per 30 parts by weight of the bath. Then a nickel plate is tinned electrochemically at a temperature of 20° C. at current density of 350 A/m$^2$. A homogeneous, bright tin coating is obtained.

We claim:

1. In a method for the electrodeposition of bright tin coatings by the use of an electroplating bath comprising a solution of stannous sulfate and sulfuric acid, the improvement which comprises adding to the bath an alcoholic solution containing from 14 to 30 percent by weight of a surface active agent, from 0.5 to 5 percent by weight of an unsaturated carbonyl compound containing an aryl group, from 1.0 to 10.0 percent by weight of the product of transesterification of a natural fat, and at least one of the following ingredients: from 0 to 8 percent by weight of an ester of an unsaturated acid and from 0 to 15 percent by weight of compound containing an ether group, the said solution being added to the bath in the ratio of 1 part of solution to 20 to 35 parts by weight of the bath.

* * * * *